US008746847B2

(12) United States Patent
Kishikawa et al.

(10) Patent No.: US 8,746,847 B2
(45) Date of Patent: Jun. 10, 2014

(54) INK JET PRINT HEAD

(75) Inventors: Shinji Kishikawa, Yokohama (JP); Ken Tsuchii, Sagamihara (JP); Masataka Sakurai, Kawasaki (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 667 days.

(21) Appl. No.: 12/684,415

(22) Filed: Jan. 8, 2010

(65) Prior Publication Data

US 2010/0201748 A1 Aug. 12, 2010

(30) Foreign Application Priority Data

Feb. 6, 2009 (JP) ..... 2009-026168

(51) Int. Cl.
*B41J 2/14* (2006.01)
*B41J 2/16* (2006.01)

(52) U.S. Cl.
USPC ..... 347/50

(58) Field of Classification Search
USPC ..... 347/50
See application file for complete search history.

(56) References Cited

U.S. PATENT DOCUMENTS

| | | | | |
|---|---|---|---|---|
| 6,719,408 | B2 * | 4/2004 | Yoshihira et al. | 347/65 |
| 6,726,308 | B2 | 4/2004 | Lee et al. | |
| 6,824,254 | B2 * | 11/2004 | Koike et al. | 347/71 |
| 7,263,773 | B2 | 9/2007 | Lee et al. | |
| 7,549,734 | B2 * | 6/2009 | Imanaka et al. | 347/58 |
| 7,591,531 | B2 | 9/2009 | Tsuchii et al. | |
| 2008/0055368 | A1 | 3/2008 | Oikawa et al. | |
| 2008/0136872 | A1 | 6/2008 | Tsuchii et al. | |
| 2008/0246813 | A1 * | 10/2008 | Murakami et al. | 347/54 |
| 2009/0058948 | A1 | 3/2009 | Kasai et al. | |
| 2009/0066752 | A1 | 3/2009 | Ide et al. | |
| 2009/0231394 | A1 * | 9/2009 | Inoue et al. | 347/67 |

FOREIGN PATENT DOCUMENTS

| | | | |
|---|---|---|---|
| JP | 62-172483 | A | 7/1987 |
| JP | 1-76239 | U | 5/1989 |
| JP | 2001-341309 | | 12/2001 |
| JP | 2002-52716 | A | 2/2002 |
| JP | 2004-268393 | A | 9/2004 |
| JP | 2008-120003 | A | 5/2008 |
| JP | 2008-162270 | | 7/2008 |
| JP | 2008-254304 | A | 10/2008 |

OTHER PUBLICATIONS

Office Action dated Jan. 15, 2013, in Japanese Application No. 2009-026168.

Office Action dated Aug. 20, 2013, in Japanese Application No. 2009-026168.

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

An ink jet print head is configured to reduce the inclination of an ink ejection direction to make improper print conditions such as stripes and density unevenness unnoticeable. An individual wire is extended to lie under a common wire. Thus, wires under ink channels arranged on the respective opposite sides of a pressure chamber are symmetric. Consequently, an equivalent step structure is provided at the bottoms of the ink channels arranged on the respective opposite sides of the pressure chamber.

9 Claims, 16 Drawing Sheets

INK JET PRINT HEAD

BACKGROUND OF THE INVENTION

1. Field of the Invention

The present invention relates to an ink jet print head, and in particular, to an ink jet print head in which a print element configured to generate thermal energy required to eject ink and a driving circuit configured to drive the print element s are formed on the same board.

The present invention is applicable not only to general print apparatuses but also apparatuses such as copiers, facsimile machines, and word processors as well as industrial print apparatuses combined with various processing apparatuses.

2. Description of the Related Art

An ink jet print apparatus is configured to print information on a print medium in response to a print signal by allowing a print head to eject ink through a plurality of fine nozzles. The ink jet print apparatus advantageously enables high-speed printing and offers high resolution and high image quality, while allowing a reduction in noise. The ink jet print apparatus is thus commonly used.

Some print heads used in ink jet print apparatuses are of an ink jet type configured to utilize thermal energy for printing. Such a print head allows print elements to be energized to heat ink to generate bubbles. Thus, pressure resulting from the generation of the bubbles is utilized to eject the ink through ejection ports for printing. Furthermore, the ink ejected through the ejection ports flies perpendicularly to the principal surface of a print element board. The ink thus impacts a print medium at a desired position. As a result, high-quality and high-grade printing is achieved.

However, if the ejection ports are inclined to the principal surface of the print element board or ink channels are shaped asymmetrically with respect to a corresponding pressure chamber, energy applied to the ink by the pressure resulting from the generation of bubbles is also asymmetric with respect to the pressure chamber. The asymmetry may cause the ejection direction of the ink to be inclined to the direction perpendicular to the principal surface of the print element board. Thus, the ink may impact the print medium at a position different from the desired one, thus lowering the print grade.

Thus, for the proper print grade, the ejection direction of the ink needs to be perpendicular to the principal surface of the print element board. In this case, the inclination of the ejection ports and the shape of the ink channels are important. Various methods have been proposed which are intended to reduce the inclination of the ejection direction of the ink to the direction perpendicular to the principal surface of the print element board.

Japanese Patent Laid-Open No. 2001-341309 describes that a print element in a recess portion is shaped rotationally symmetrically with respect to the center line of each ejection port, thus preventing ejected ink from flying in an inclined direction.

Furthermore, Japanese Patent Laid-Open No. 2008-162270 discloses a print head in which two channels are formed symmetrically with respect to each ejection port.

However, Japanese Patent Laid-Open Nos. 2001-341309 and 2008-162270 fail to refer to a phenomenon in which a step that may be formed on the bottom surface of the ink channel may disrupt the symmetry, causing the ejected ink to fly in an inclined direction. The present inventors have newly found that not only the symmetry of the channels but also a step of height several μm resulting from wires formed at the channel may affect the ejection direction.

A print element is provided in the pressure chamber and requires wires for energization. The wires connected to the print element normally include an individual wire and a common wire. Furthermore, to allow a reduction in wire installation area, the individual and common wires may be provided separately in the same layer, in a stack board, as that of the print element and in an underlying layer. When such a wiring layer is provided under the ink channel, a step structure is created on the inner bottom surface of the ink channel, that is, the surface of the board. If the step structure is present only in one of the ink channels arranged on the respective opposite sides of the pressure chamber, then the bottom surfaces of the ink channels are asymmetric with respect to the pressure chamber. The asymmetric structure of the ink channels may result in a difference in flow resistance between the ink channels. In this case, during ejection, pressure is generated in a biased manner. As a result, the ejected ink is inclined to the direction perpendicular to the principal surface of the print element board. Consequently, the ink may impact the print medium at an incorrect position or images may be unevenly formed.

SUMMARY OF THE INVENTION

Thus, an object of the present invention is to provide an ink jet print head configured to reduce the inclination of an ink ejection direction to make improper print conditions such as stripes and density unevenness unnoticeable.

In a first aspect of the present invention, an ink jet print head comprising a pressure chamber including a print element configured to heat ink to generate bubbles, two ink channels formed symmetrically with respect to the pressure chamber so that the ink is allowed to flow into the pressure chamber, and a plurality of wires arranged under a bottom portion of each of the ink channels, wherein the same flow resistance is set for the two ink channels.

In a second aspect of the present invention, a liquid ejection head comprising:

a pressure chamber having energy generation device that generates energy used to eject liquid;

two channels provided opposite each other across the pressure chamber so that the liquid is allowed to flow into the pressure chamber;

a wire provided under the bottom surface of one of the two channels, the wire for connecting electrically the energy generation device; and a dummy wire arranged under the bottom surface of the other channel of the two channels.

The ink jet print head according to the present invention allows substantially the same flow resistance to be set for the two ink channels connected to the pressure chamber. Thus, the ink jet print head provided by the present invention enables a reduction in the inclination of the ink ejection direction to make improper print conditions such as stripes and density unevenness unnoticeable.

Further features of the present invention will become apparent from the following description of exemplary embodiments (with reference to the attached drawings).

DESCRIPTION OF THE EMBODIMENTS

First Embodiment

A first embodiment of the present invention will be described below with reference to the drawings.

Figure 1:
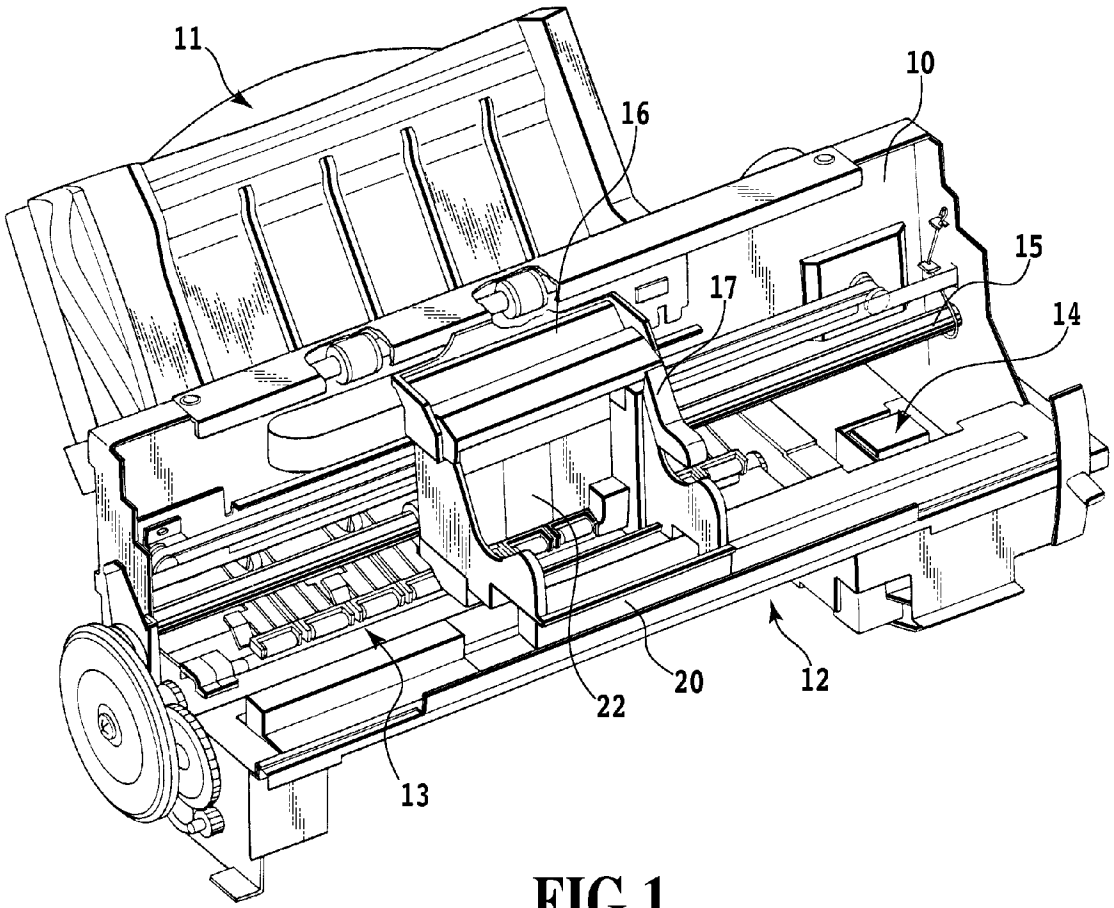
FIG. 1 is a diagram showing the appearance of a mechanism portion of an ink jet print apparatus according to a first embodiment.
Figure 2:
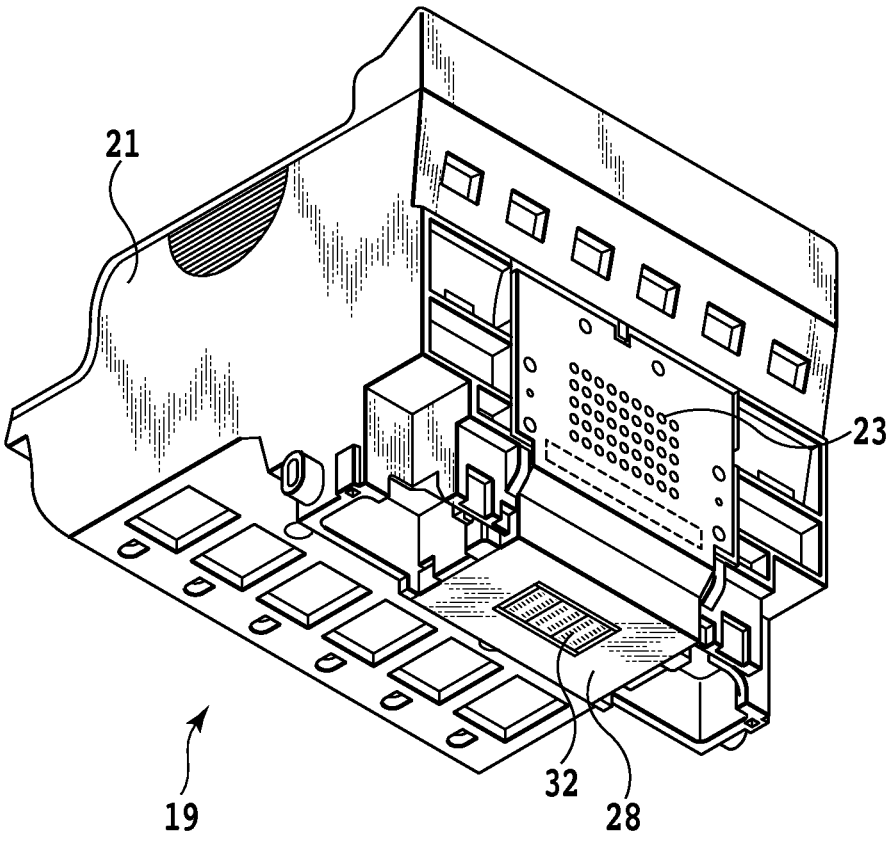
FIG. 2 is a diagram showing the appearance of a head cartridge used in the ink jet print apparatus according to a first embodiment.
Figure 3:
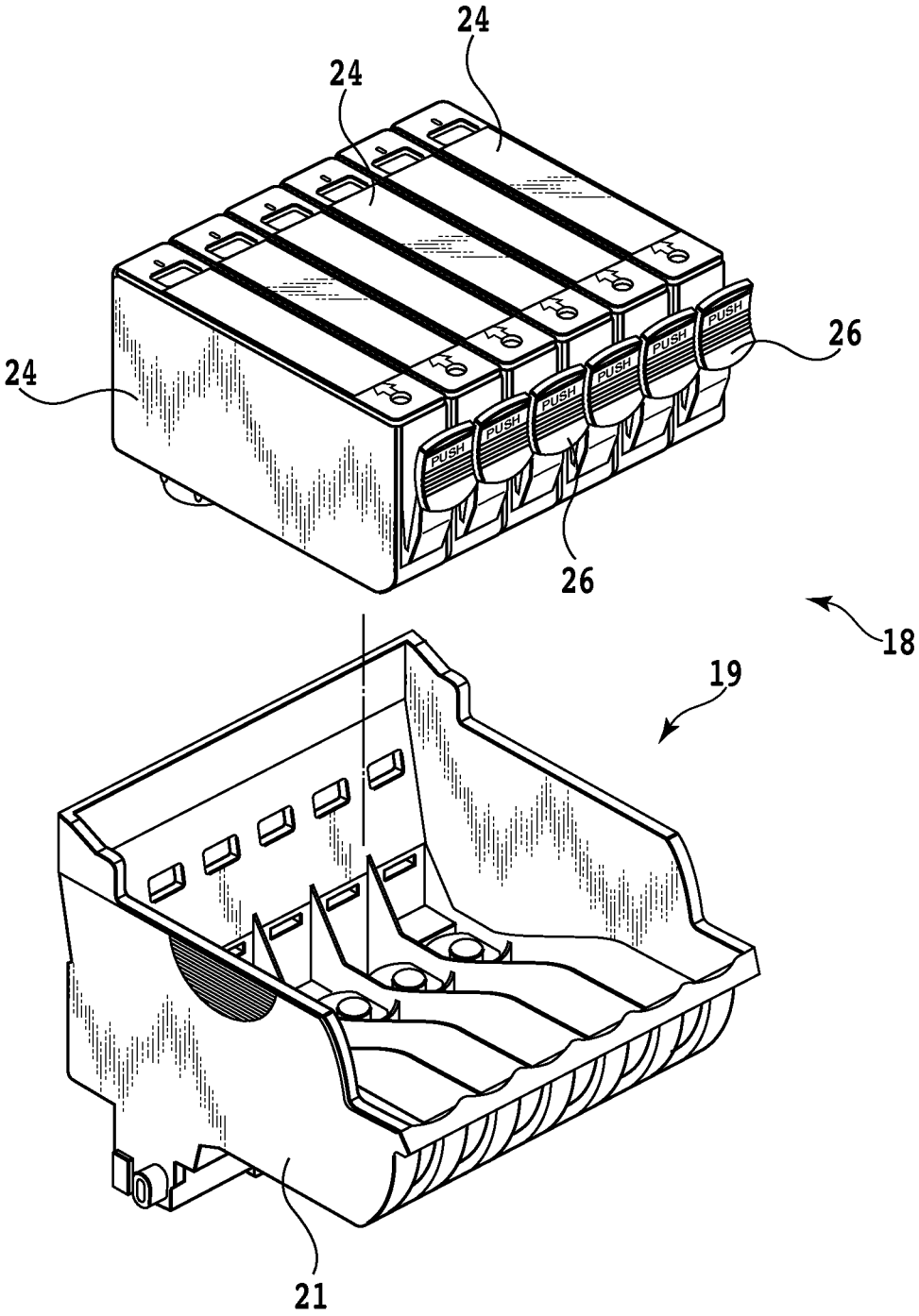
FIG. 3 is a diagram showing the appearance of an ink jet print head in the head cartridge.

FIG. 1 is a diagram showing the appearance of a mechanism portion of an ink jet print apparatus to which an ink jet print head according to the present embodiment is applicable. FIG. 2 is a diagram showing the appearance of a head cartridge used in the ink jet print apparatus in FIG. 1. Moreover, FIG. 3 is a diagram showing the appearance of an ink jet print head in the head cartridge. A chassis 10 of the ink jet print apparatus according to the present embodiment comprises a plurality of plate-like metal members with a predetermined rigidity. The chassis 10 forms the framework of the ink jet print apparatus. The chassis 10 includes a medium feeding section 11 configured to feed a sheet-like print medium (not shown in the drawings) to the interior of the ink jet print apparatus. The chassis 10 further includes a medium conveying section 13 configured to guide the print medium fed from the medium feeding section 11 to a desired print position and from the print position to a medium discharge section 12, a print section configured to perform a predetermined printing operation on the print medium, and a head recovery section 14 configured to execute a recovery process on the print section.

The print section comprises a carriage 16 supported so as to be movable along a carriage shaft 15 for scanning, and a head cartridge 18 mounted in the carriage 16 so as to be removable via a head set lever 17.

The carriage 16 in which the head cartridge 18 is mounted includes a carriage cover 20 configured to position an ink jet print head (hereinafter also simply referred to as a print head) 19 at a predetermined installation position on the carriage 16. The carriage 16 further includes the head set lever 17 configured to engage with a tank holder 21 in the print head 19 to press and place the print head 19 at the predetermined installation position. The head set lever 17, serving as removal means according to the present invention, is pivotally movable with respect to a head set lever shaft (not shown in the drawings) located at the top of the carriage 16. Furthermore, a spring-loaded head set plate (not shown in the drawings) is provided in a portion of the carriage 16 configured to engage with the print head 19. The spring force of the head set plate allows the print head 19 to be pressed and installed in the carriage 16.

One end of a contact flexible print cable (hereinafter also referred to as a contact FPC) 22 is coupled to another portion of the carriage 16 configured to engage with the print head 19. A contact portion (not shown in the drawings) formed at this end of the contact FPC 22 electrically contacts a contact portion 23 provided in the print head 19 and serving as an external-signal input signal. This allows the transmission of various pieces of information for printing, the supply of power to the print head 19, and the like.

An elastic member such as rubber (not shown in the drawings) is provided between the contact portion of the contact FPC 22 and the carriage 16. The elastic force of the elastic member and the pressing force of the head set plate enable the contact portion of the contact FPC 22 to reliably contact the contact portion 23 of the print head 19. The other end of the contact FPC 22 is connected to a carriage board (not shown in the drawings) mounted on the rear surface of the carriage 16.

The head cartridge 18 according to the resent embodiment includes an ink tank 24 in which ink is stored, and the above-described print head 19 configured to eject ink fed from the ink tank 24, through ejection ports in accordance with print information. The print head 19 according to the present embodiment is of what is called a cartridge type in which the print head 19 is removably mounted in the carriage 16.

Furthermore, the present embodiment allows six independent ink tanks 24 for the respective ink colors, that is, black (Bk), pale cyan (c), pale magenta (m), cyan (C), magenta (M), and yellow (Y) to be used for the apparatus in order to enable photographic high-quality color printing. Each of the ink tanks 24 includes an elastically deformable removal lever 26 that can be locked on the head cartridge 18. Operation of the removal lever 25 enables the ink tank 24 to be removed from the print head 19 as shown in FIG. 3. Thus, the removal lever 26 functions as a part of removal means according to the present invention. The print head 19 comprises a print element board, an electric wiring board 28, and the above-described tank holder 21. The print element board is electrically connected to the electric wiring board 28 via contacts at square slots 25 formed in the electric wiring board 28.

Figure 4:
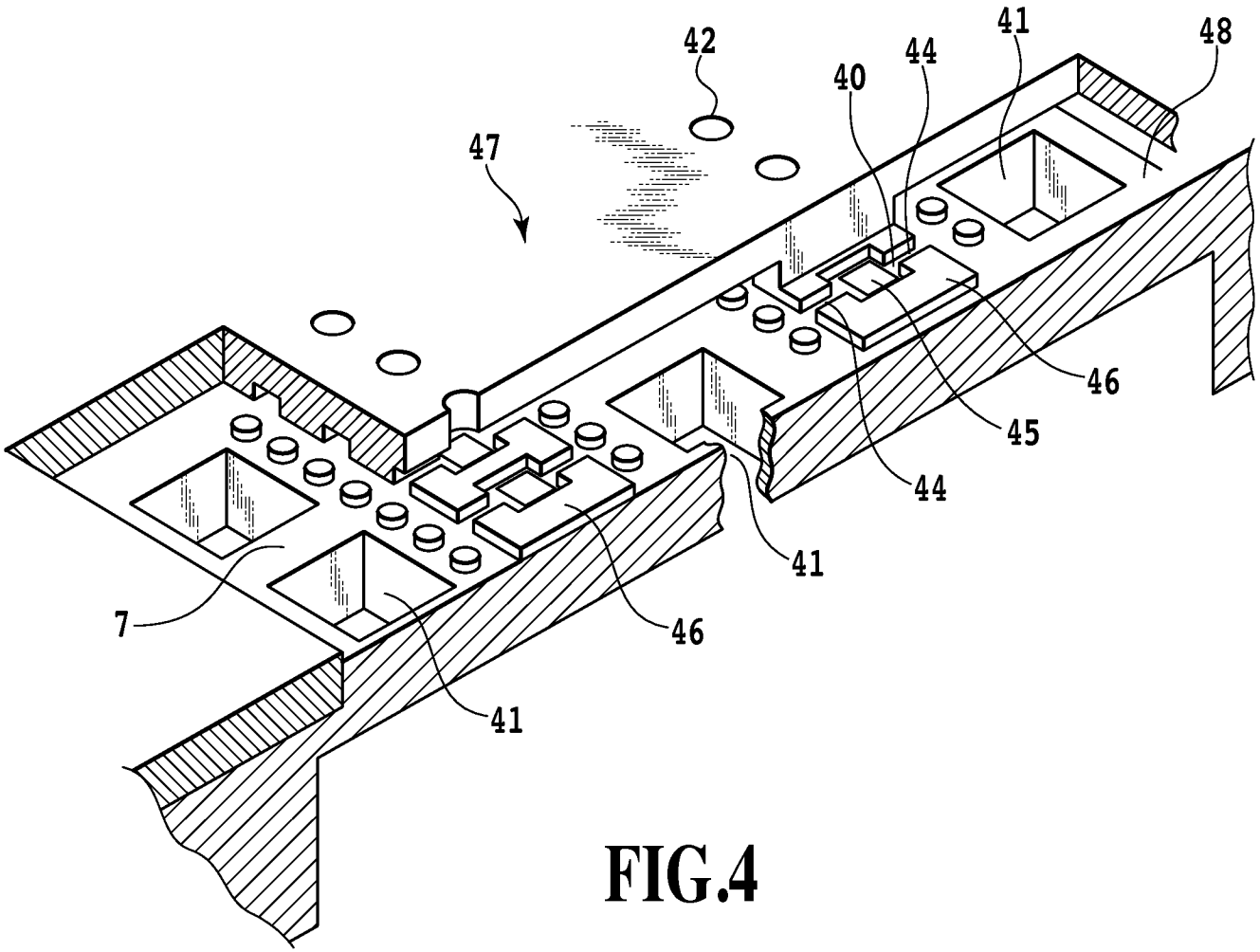
FIG. 4 is a partly-sectional schematic perspective view showing a print head applicable to the present invention.

FIG. 4 is a partly-sectional schematic perspective view showing a print head applicable to the present invention. In the print head according to the present embodiment, a plurality of ink channels 44 and a plurality of ink supply ports 41 are arranged on a print element board 48 for a pressure chamber 40. Moreover, a row of pressure chambers 40 are formed on the print element board 48 by channel walls 46 forming ink channels 94. Print elements 45 are provided in the respective pressure chambers 40 so as to form a row of print elements. The ink supply ports 41 are arranged along the direction in which the print elements 45 are arranged. Each of the print elements 45 generates heat during printing to heat the ink, thus allowing pressure to be exerted. Consequently, ink can be ejected through ejection ports 42.

The print element board 98 in the ink jet print head according to the present embodiment is a stack board comprising an oxide film provided on a silicon substrate, a lower wiring layer, an insulating layer, print elements 45, an upper wiring layer, and an insulating layer provided on the oxide film in this order. A nozzle material 47 is used to form nozzles on the insulating layer. Ink is fed from the back surface of the silicon substrate through the ink supply ports 41 formed as holes penetrating the silicon substrate. Electric energy is applied to the print elements 45 to heat and bubble the ink. The ink is thus ejected through the ejection ports 42 for printing.

In the present embodiment, two ink channels 44, through which ink supplied through the ink supply port 41 can flow into the pressure chamber 40, are formed symmetrically with respect to the pressure chamber 40. That is, the ink channels 99 are provided opposite each other across the pressure chamber 40. The thus symmetrically formed ink channels 44 prevent the pressure resulting from heat generated by the print head 45 from acting in a biased manner inside the pressure chamber 90. The ink can thus be ejected perpendicularly to the print head (the principal surface of the print element board).

Figure 5:
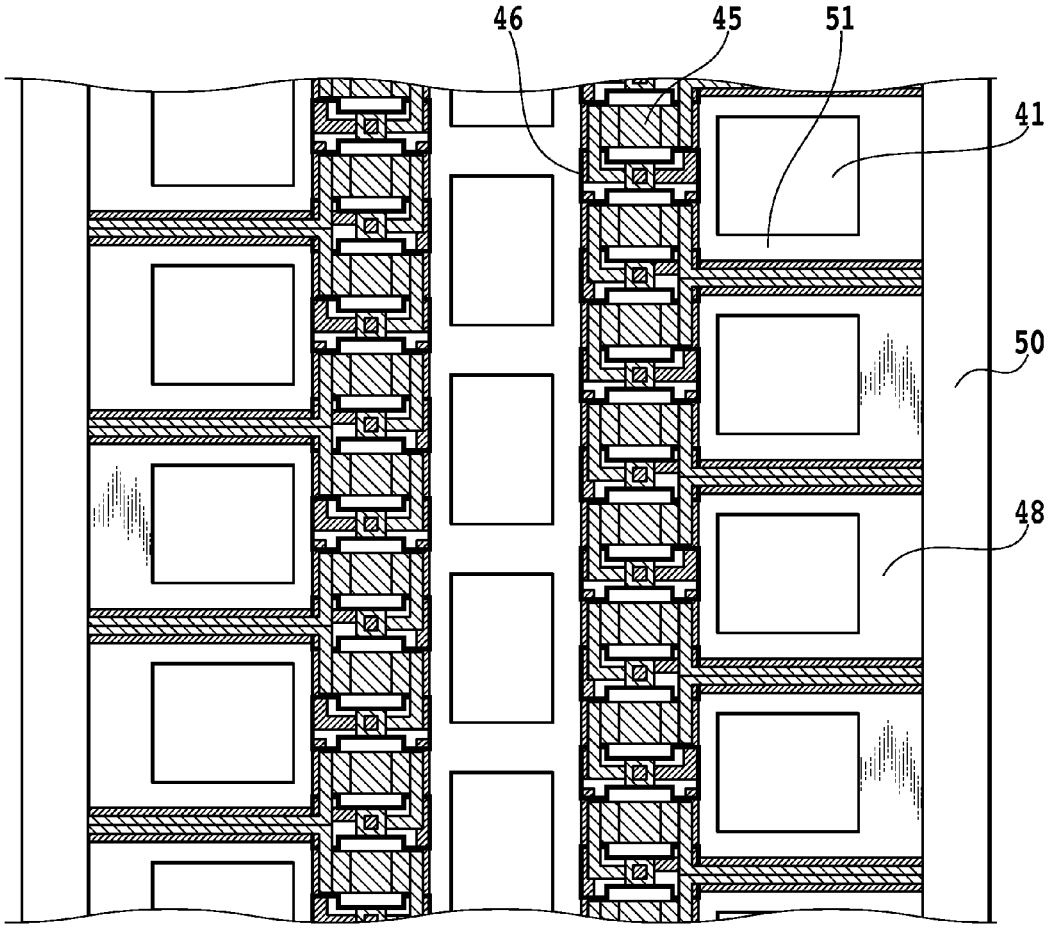
FIG. 5 is an enlarged diagram showing a part of the print head according to a first embodiment.
Figure 6:
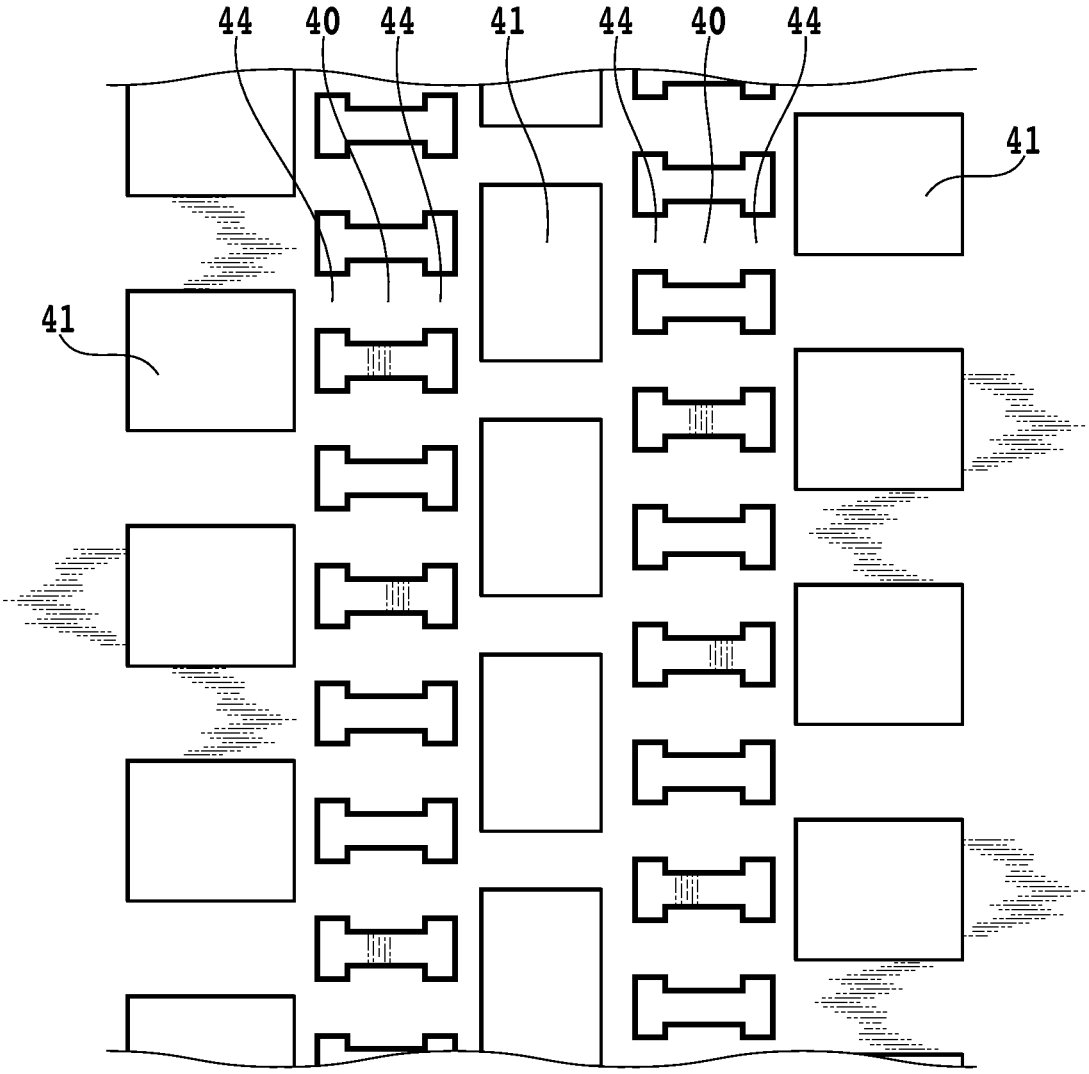
FIG. 6 is an enlarged diagram showing ink supply ports and channel walls in the print head according to the first embodiment.
Figure 7:
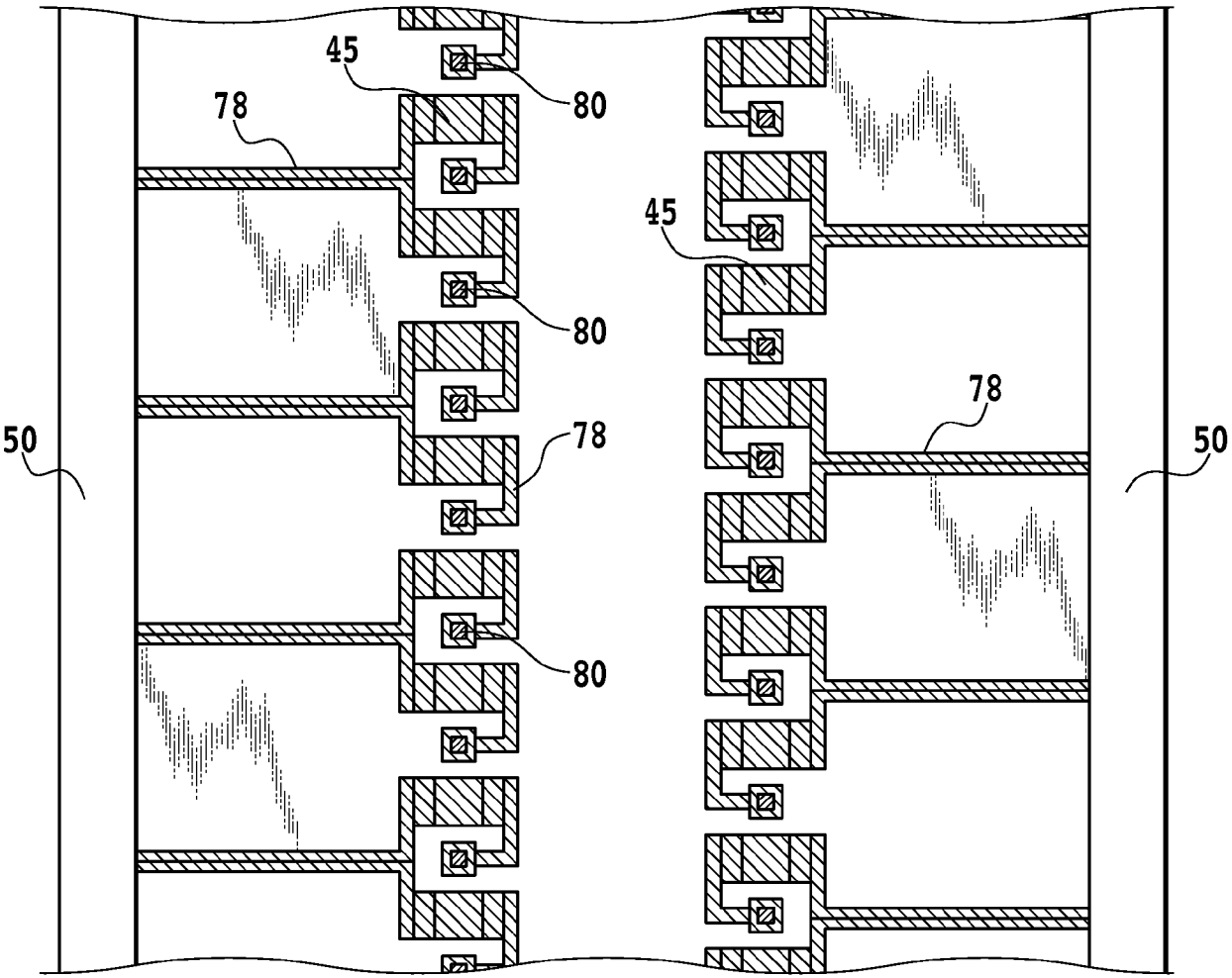
FIG. 7 is a diagram showing wires connected to print elements in the print head according to the first embodiment.
Figure 8:
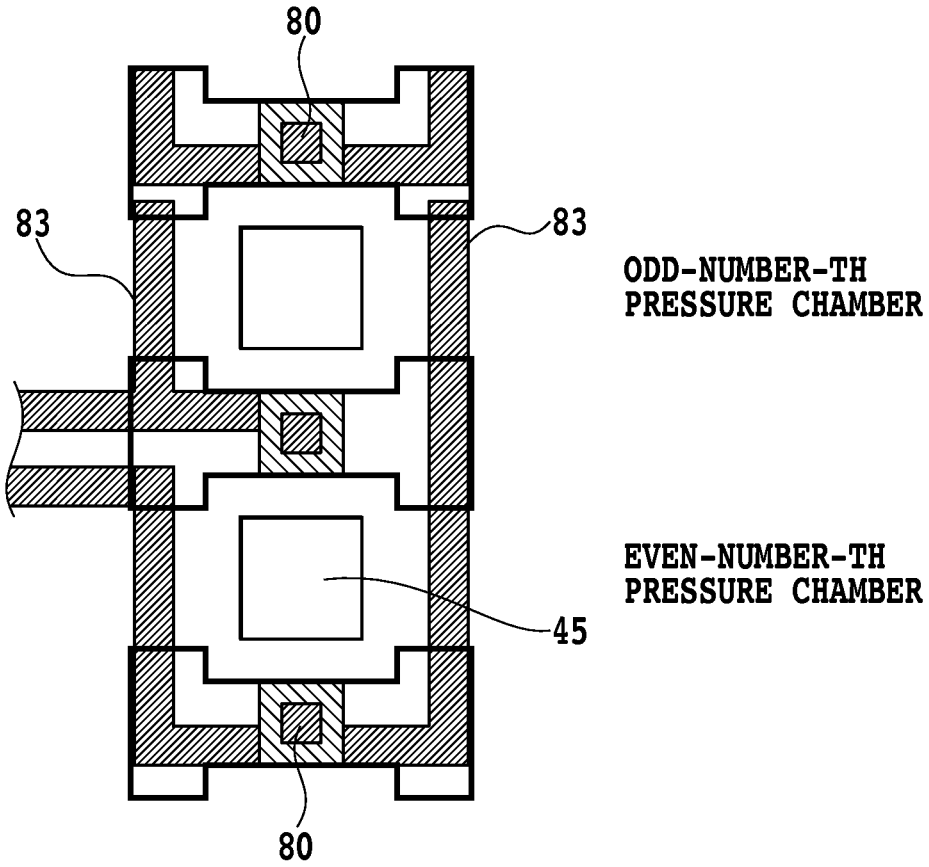
FIG. 8 is a diagram showing wires connected to print elements in the print head according to the first embodiment.
Figure 9:
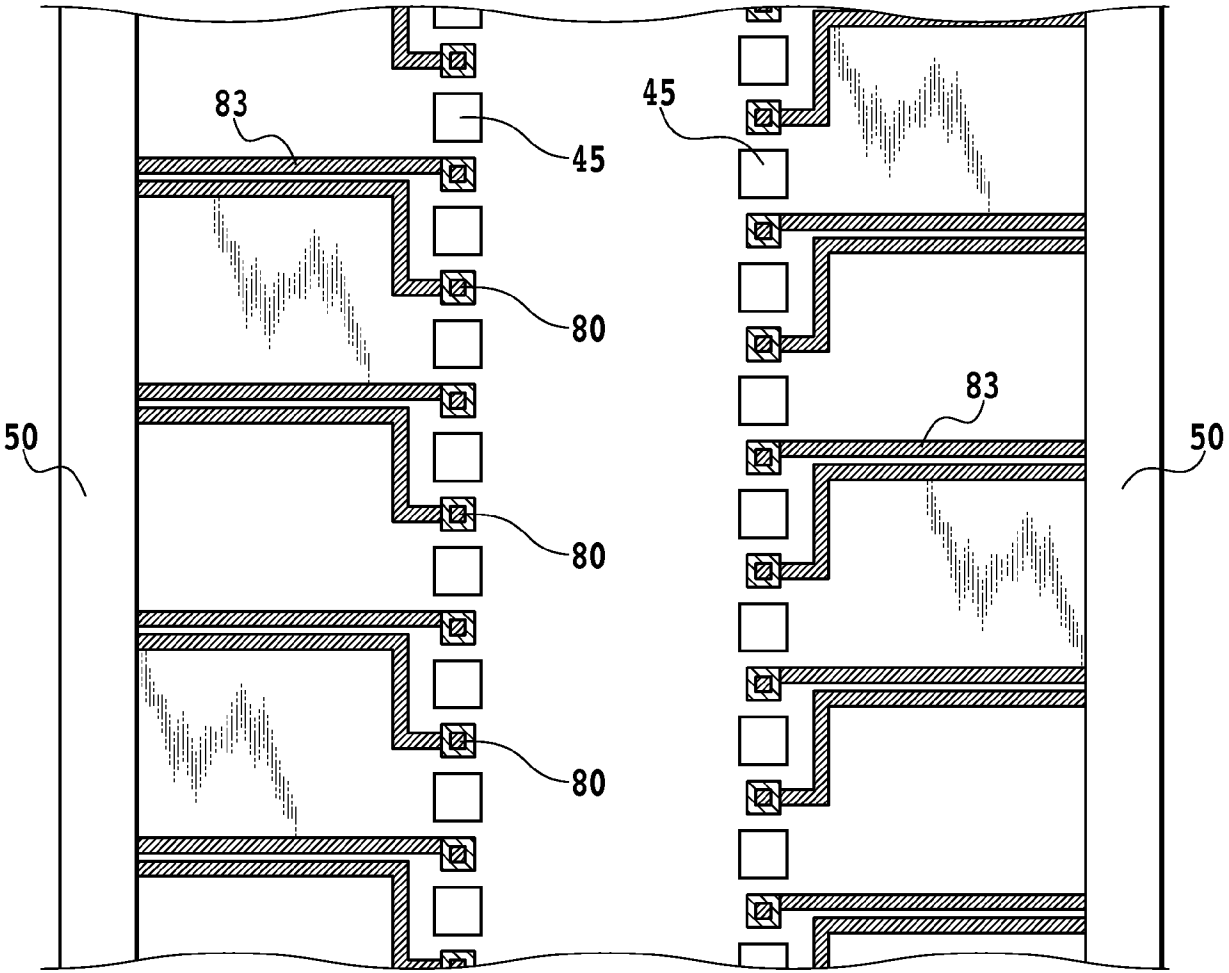
FIG. 9 is a diagram showing individual wires in a lower wiring layer as a comparative example.

FIG. 5 is an enlarged view of a part of the print head according to the present embodiment. Wires through which electric energy is supplied to the print element 95 are arranged using a beam 51 formed between the ink supply ports 41 in the board as shown in FIG. 5. FIG. 6 is an enlarged diagram showing the ink supply ports 41 and channel walls 46 in the print head according to the present embodiment. Furthermore, FIGS. 7 and 8 are diagrams showing the wires connected to the print elements 45 in the print head according to the present embodiment. FIG. 7 shows a common wire provided in the upper wiring layer. FIG. 8 shows an individual wire provided in the lower wiring layer. FIG. 9 is a diagram showing individual wires in the lower wiring layer as a comparative example. A common wire 78 electrically connects the power source and the print element 45 together. An individual wire 83 electrically connects the print element 45 and a driving circuit 50 together.

The common wire 78 shown in FIG. 7 is electrically connected to the individual wire 83 shown in FIGS. 8 and 9, via a through-hole 80 formed between the adjacent ink supply ports. Energization of the wires enables the print element 45 to be energized to generate heat. Simply allowing the print element to generate heat can be achieved by connecting the through-hole 80 to the driving circuit row 50 as in the case of the individual wire 83 shown in FIG. 9. However, in this case, a step structure is created on the surface of the print element board 48 at the ink channel 99. The step structure will be described below.

Figure 10:
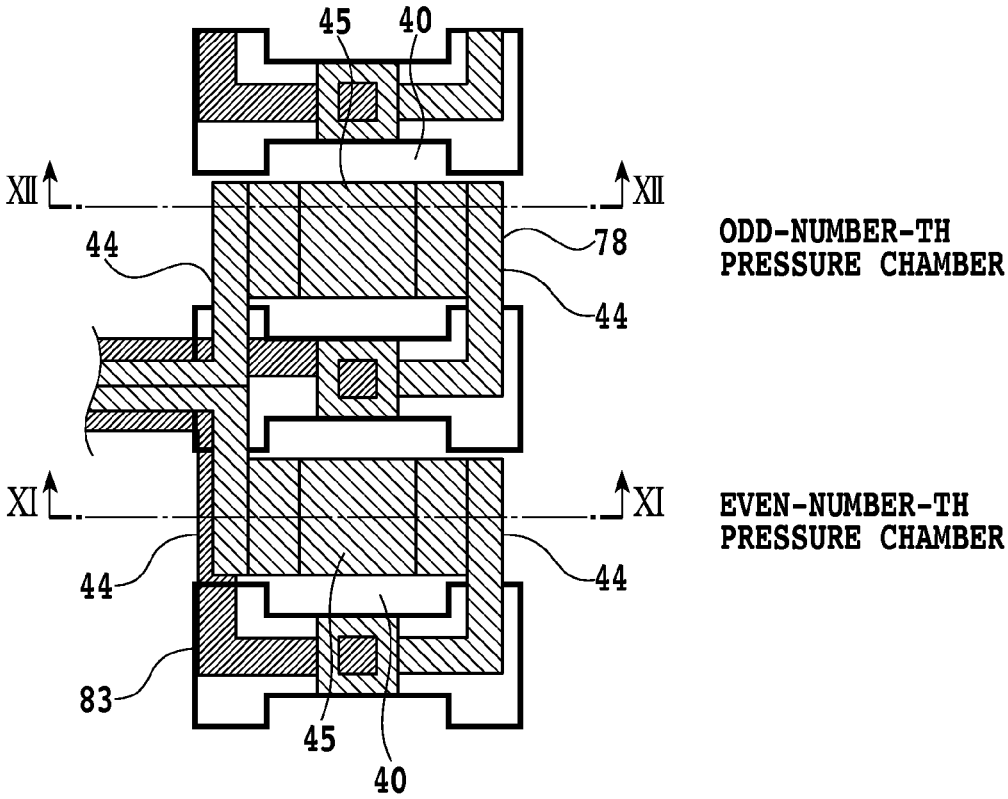
FIG. 10 is a diagram overlappingly showing a common wire and an individual wire in the comparative example.
Figure 11:
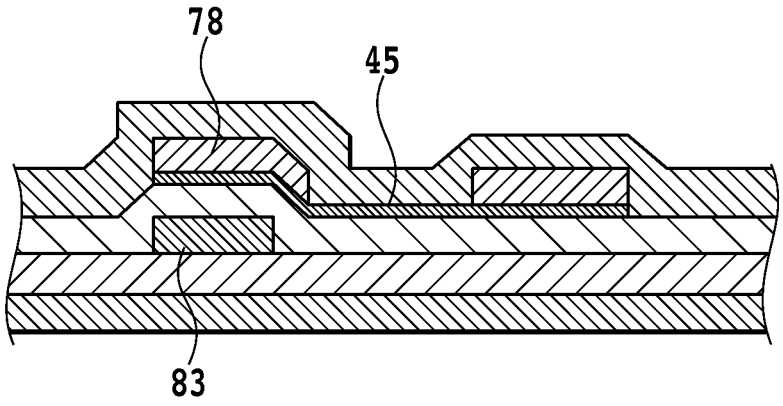
FIG. 11 is a sectional view of an ink channel portion of the even-number-th pressure chamber from the end of a print element array, the sectional view being taken along line XI-XI in FIG. 10.

FIG. 10 is a diagram overlappingly showing the common wire 78 and the individual wire 83 as a comparative example. FIG. 11 is a sectional view of the ink channel 44 portion of the even-number-th pressure chamber 40 from the end of the print element array; the sectional view being taken along line XI-XI in FIG. 10. As is apparent from FIGS. 10 and 11, the common wire 78 and the individual wire 83 are provided under one of the ink channels 44 positioned on the respective opposite sides of the print element 45. Only the common wire 78 is provided under the other ink channel 44. Thus, the ink channel 44 under which the common wire 78 and the individual wire 83 are provided is higher than the ink channel 44 under which only the common wire 78 is provided, by an amount corresponding to the individual wire 83. That is, there is a difference in height between the two ink channels 44. Such a step may cause the pressure resulting from heat generated by the print element 45 to act in a biased manner. As a result, the ink ejection direction may be bent with respect to the direction perpendicular to the print head.

Figure 12:
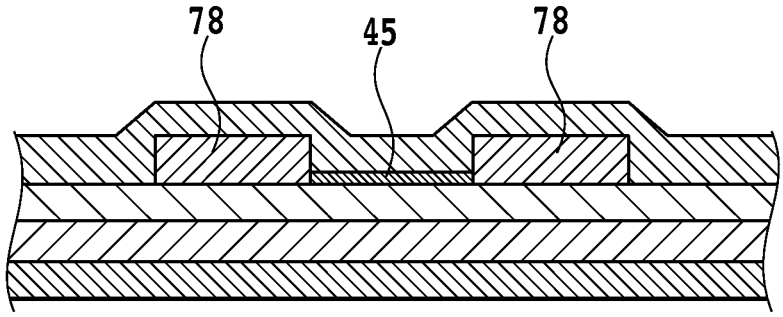
FIG. 12 is a sectional view of an ink channel portion of the odd-number-th pressure chamber from the end of the print element array, the sectional view being taken along line XII-XII in FIG. 10.

FIG. 12 is a sectional view of the ink channel 44 portion in the odd-number-th pressure chamber 40 from the end of the print element array; the sectional view is taken along line XII-XII in FIG. 10. In the odd-number-th pressure chamber 40 from the end of the print element array, the individual wire 83 is not provided under either of the common wires 78. Thus, the ink channels 44 on the respective opposite sides of the print element 45 can be provided symmetrically with respect to the pressure chamber 40, with no asymmetric step created.

As described above, the shape of the surface of the print element board 48 differs between the odd-number-th pressure chamber 90 and the even-number-th pressure chamber 40 from the end of the print element array. In the configuration in the comparative example, during printing, the step may cause a difference in impact position between the odd-number-th pressure chamber 40 and the even-number-th pressure chamber 40 from the end of the print element array.

Thus, in the present embodiment, as shown in FIG. 8, the individual wire 83 is extended such that the individual wire 83 (dummy wire) is located under both the common wires 78. The difference between the comparative example and the present embodiment is obvious from a comparison of the individual wire 83 shown in FIG. 9 as the comparative example with the individual wire 83 according to the present embodiment in FIG. 8.

Figure 13:
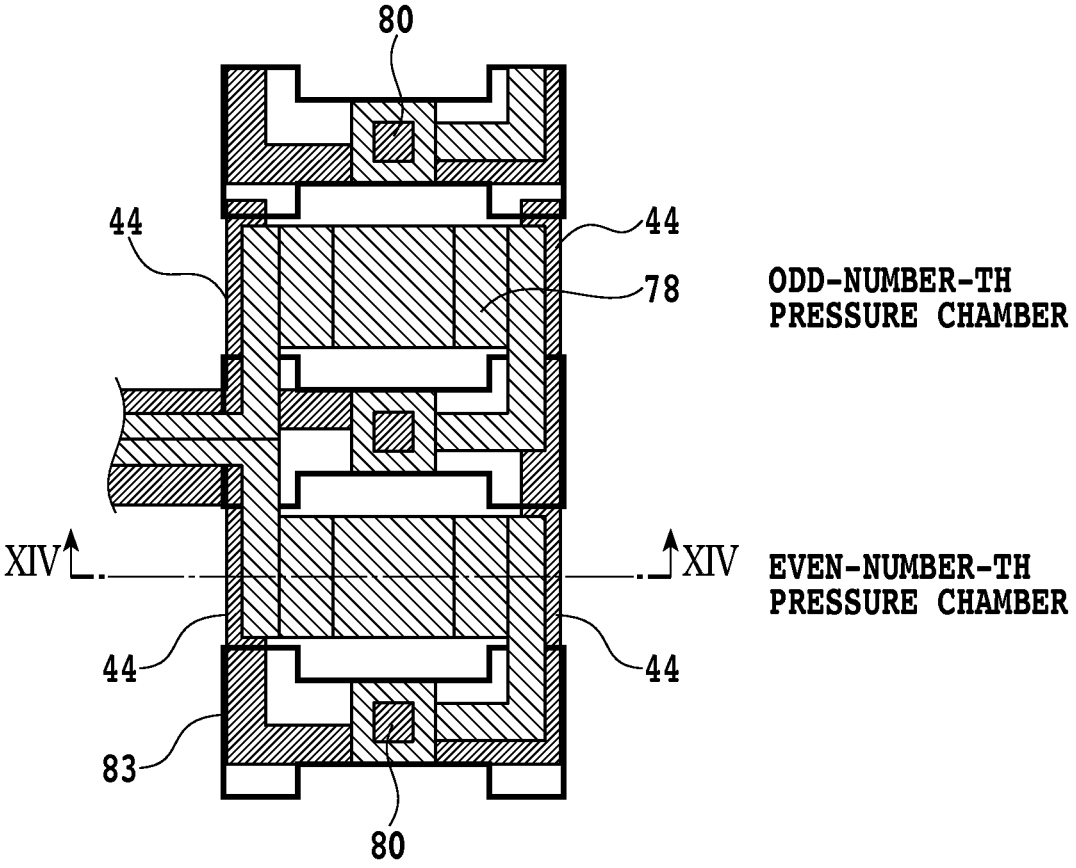
FIG. 13 is a diagram overlappingly showing a common wire and an individual wire in the first embodiment.
Figure 14:
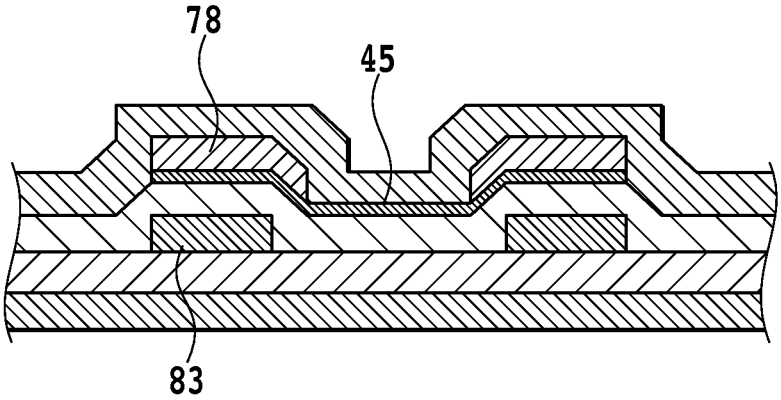
FIG. 14 is a sectional view taken along line XIV-XIV in FIG. 13.

FIG. 13 is a diagram overlappingly showing the common wire 78 and individual wire 83 according to the present embodiment. FIG. 14 is a sectional view taken along line XIV-XIV in FIG. 13. As is apparent from the figures, the common wire 78 and the individual wire 83 are provided under all the ink channels 44. When the wires are thus arranged in the ink channel, the ink channels 44 on the respective opposite sides of the print element 45 can be provided symmetrically with no asymmetric step created, regardless of whether the pressure chamber 40 is odd- or even-numbered. This allows substantially the same flow resistance to be set for the ink channels 44 arranged on the respective opposite sides of the pressure chamber. Here, the term "flow resistance" as used herein refers to the difficulty with which the ink moves in the channel and which affects the shape of bubbles. The flow resistance is determined by the physical properties of the ink and the shape of the channel.

The adverse effect of a wiring pattern on a Y deviation will be described below which is observed when 2.8 pl of droplets are ejected at 15 kHz from a print head including 256 nozzles per row and having a nozzle interval of 600 dpi. Here, the Y deviation refers to the amount of deviation between the ideal ink impact position and the actual impact position measured in the form of a value in the nozzle row direction. The distance between the print head and a print medium is 1.25 mm. The speed of the print head in the scanning direction is 25 inch/sec.

In connection with the Y deviation, in the print head shown in the comparative example, the difference in impact position between the odd-number-th print element 45 and the even-number-th print element 45 is about 10 μm. In contrast, the actual ejection condition in the print head according to the present embodiment indicates that the magnitude of the Y deviation is equivalent between the odd-number-th print element 45 and the even-number-th print element 45. This in turn indicates that the symmetric wiring pattern in the ink channel serves to reduce the inclination of the ink ejection direction to the direction perpendicular to the element board.

In the present embodiment, the ink supply ports are not provided symmetrically with respect to the pressure chamber. However, this does not substantially affect the deviation in the ejection direction. Thus, the present invention is not limited to this aspect. The ink supply ports have only to be able to supply ink to the pressure chamber and may be provided symmetrically with respect to the pressure chamber.

As described above, the individual wire is extended so as to lie under the common wire. Thus, the wires under the ink channels arranged on the respective opposite sides of the pressure chamber 40 are made symmetric. Consequently, the equivalent step structure is provided at the bottoms of the ink channels arranged on the respective opposite sides of the pressure chamber. The present embodiment thus makes the ink channels symmetric with respect to the pressure chamber. As a result, the inclination of the ink ejection direction can be reduced, thus making improper printing conditions such as stripes and density unevenness unnoticeable.

Second Embodiment

A second embodiment of the present invention will be described below with reference to the drawings. The basic configuration of the present embodiment is similar to that of the first embodiment. Thus, only the characteristic arrangements of the present embodiment will be described below.

Figure 15:
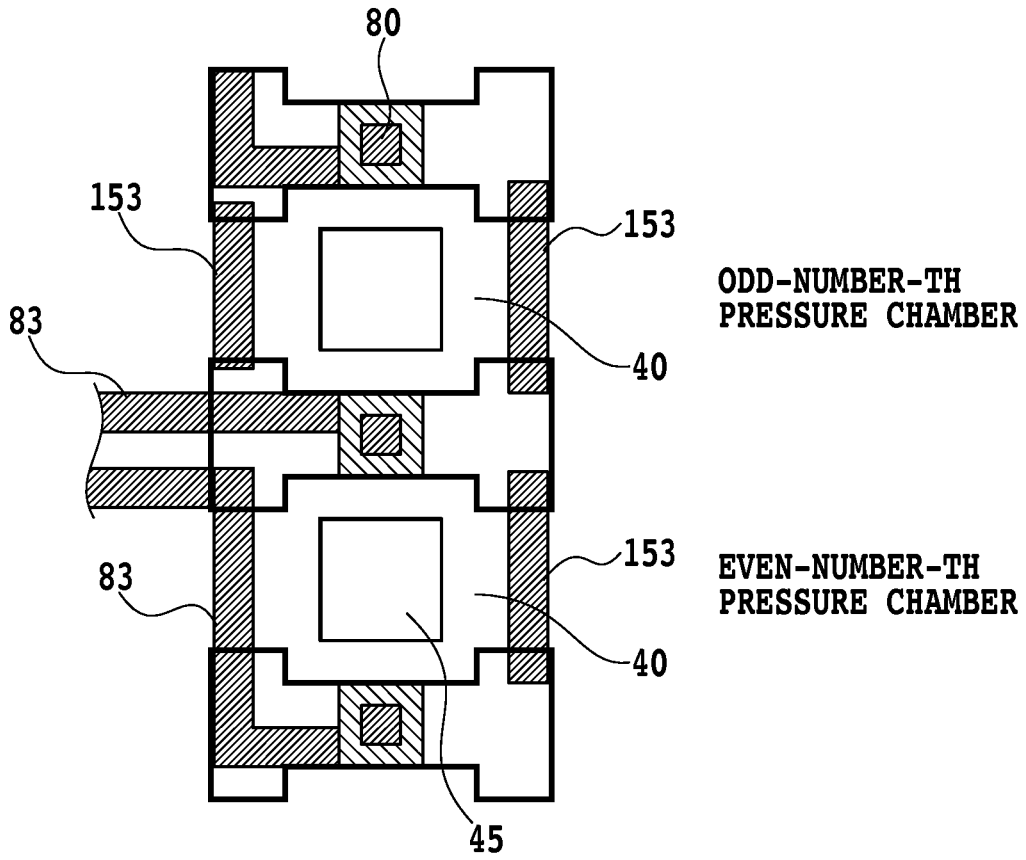
FIG. 15 is a diagram showing wires connected to print elements in a print head according to a second embodiment.

FIG. 15 is a diagram showing wires connected to print elements 45 in a print head according to the present embodiment. FIG. 15 shows an individual wire provided in the lower wiring layer. In the first embodiment, the individual wire is extended so as to lie under the common wire 78. However, the present embodiment avoids extending the individual wire 83 but uses a wire not connected to any other wire, as a dummy wire 153 provided under the common wire 78. That is, the dummy wire 153 does not contribute to energization of the print element 45. As shown in FIG. 15, in the even-number-th pressure chamber 40 from the end of the print element array, one dummy element 153 is provided under the ink channel. In the odd-number-th pressure chamber 40 from the end of the print element array, two dummy elements 153 are provided under the ink channel.

Figure 16:
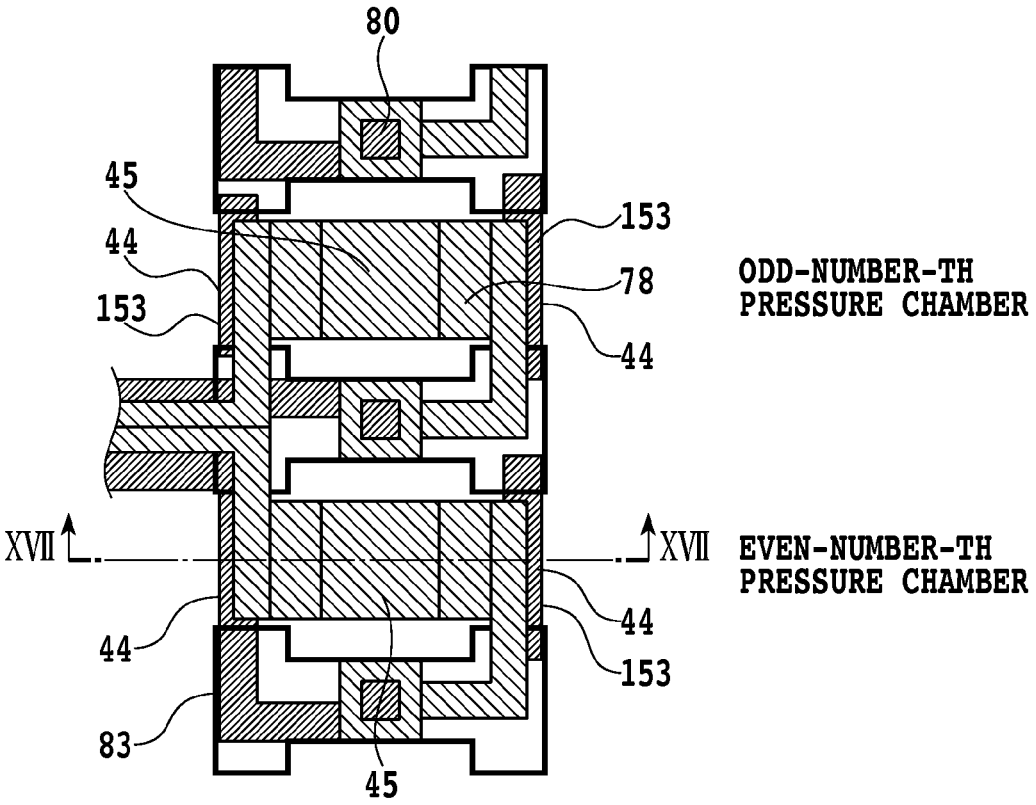
FIG. 16 is a diagram overlappingly showing the common wire and an individual wire according to the present embodiment.

FIG. 16 is a diagram overlappingly showing the common wire 78 and the individual wire 153 according to the present embodiment. As is apparent from FIG. 16, the dummy wire 153 is provided under the common wire 78 in both the even- and odd-number-th pressure chambers from the end of the print element array.

Figure 17:
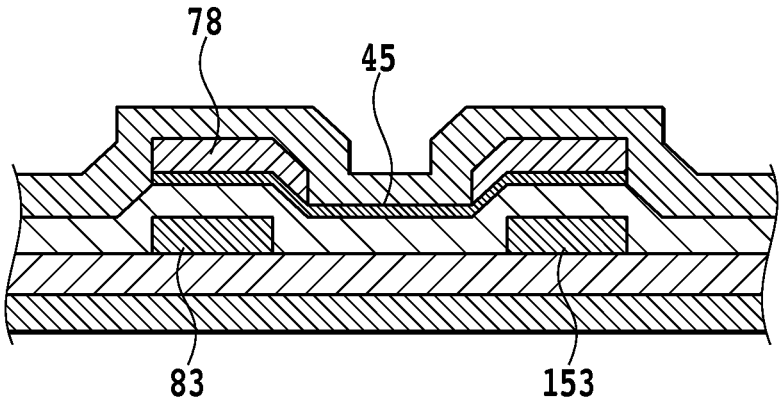
FIG. 17 is a sectional view taken along line XVII-XVII in FIG. 16.

FIG. 17 is a sectional view taken along line XVII-XVII in FIG. 16. As is the case with FIG. 14 for the first embodiment, the individual wire 83 and the dummy wire 153 are provided under the common wire 78 on each of the opposite sides of the print element 45. Thus, the ink channels 44 on the respective opposite sides of the print element 45 can be formed with no asymmetric step created. This enables substantially the same flow resistance to be set for the ink channels 44 on the respective opposite sides of the print element 45.

The actual ejection condition of the print head according to the present embodiment indicates that the Y deviation is reduced compared to that in the comparative example shown in FIG. 10, as is the case with the first embodiment. This in turn indicates that the symmetric wires based on the dummy wire 153 serve to reduce the inclination of the ink ejection direction to the direction orthogonal to the element board.

As described above, the present embodiment avoids extending the individual wire but provides the dummy wire not connected to any other wire, under the common wire. Thus, the wires under the ink channels arranged on the respective opposite sides of the pressure channels are made symmetric. Consequently, the equivalent step structure is provided at the bottoms of the ink channels arranged on the respective opposite sides of the pressure chamber. The present embodiment thus makes the ink channels symmetric with respect to the pressure chamber 40. As a result, the inclination of the ink ejection direction can be reduced, thus making improper printing conditions such as stripes and unevenness unnoticeable. In the present embodiment, the dummy wires 153 are formed on the respective opposite sides of the odd-number-th pressure chamber 40. However, since no individual wire is provided under the two channels connected to the odd-number-th pressure chamber, the dummy wires 153 may be omitted.

Third Embodiment

A third embodiment of the present invention will be described below with reference to the drawings. The basic configuration of the present embodiment is similar to that of the first embodiment. Thus, only the characteristic arrangements of the present embodiment will be described below.

Figure 18:
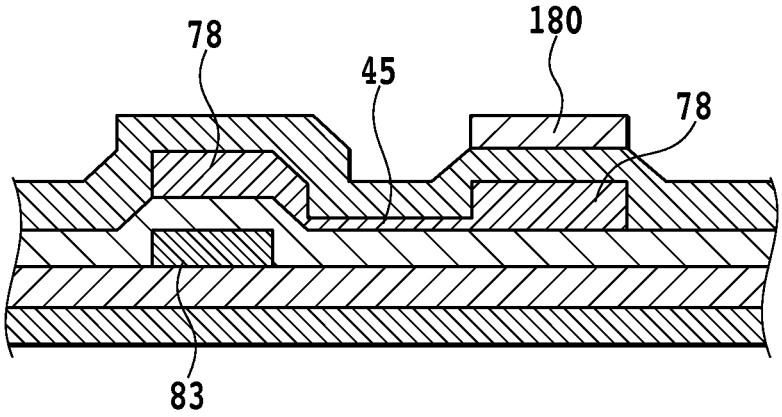
FIG. 18 is a sectional view of a portion of a print head according to a third embodiment which corresponds to a pressure chamber.

FIG. 18 is a sectional view of a portion of a print head according to the present embodiment which corresponds to a pressure chamber. In the present embodiment, the individual wire 83 is provided only on one side, but a member 180 formed of the same material as that of the nozzle material 47 is additionally stuck to the surface of the print element board 48 at the ink channel. Thus, a step is formed so as to make the flow resistance equal between the ink channels arranged on the respective opposite sides of the pressure chamber.

The actual ejection condition of the print head according to the present embodiment indicates that the Y deviation is reduced compared to that in the comparative example shown in FIG. 10, as is the case with the first embodiment. This in turn indicates that by sticking the member 180 formed of the same material as that of the nozzle material 47 to the board for symmetry, the inclination of the ink ejection direction to the direction orthogonal to the element board is reduced.

As described above, the member 180 formed of the same material as that of the nozzle material 47 is stuck to the surface of the print element board 48. Thus, the wires under the ink channels arranged on the respective opposite sides of the pressure channels are made symmetric. Consequently, the equivalent step structure is provided at the bottoms of the ink channels arranged on the respective opposite sides of the pressure chamber. The present embodiment thus makes the ink channels symmetric with respect to the pressure chamber. As a result, the inclination of the ink ejection direction can be reduced, thus making improper printing conditions such as stripes and unevenness unnoticeable.

Fourth Embodiment

A fourth embodiment of the present invention will be described below with reference to the drawings. The basic configuration of the present embodiment is similar to that of the first embodiment. Thus, only the characteristic arrangements of the present embodiment will be described below.

In the third embodiment, the member 180 is formed of the nozzle material. However, in the present embodiment, the member 180 is formed of a material (for example, a polyetheramide-containing resin HIMAL manufactured by Hitachi Chemical Co., Ltd.) allowing the nozzles and the print element board 48 to be tightly contacted.

The actual ejection condition of the print head according to the present embodiment indicates that the Y deviation is reduced compared to that in the comparative example shown in FIG. 10, as is the case with the first embodiment. This in turn indicates that by sticking the member 180 formed of the material allowing the nozzles and the print element board 48 to be tightly contacted, to the board for symmetry, the inclination of the ink ejection direction to the direction orthogonal to the element board is reduced.

As described above, the member 180 formed of the material allowing the nozzles and the print element board 48 to be tightly contacted is stuck to the surface of the print element board 48. Thus, the wires under the ink channels arranged on the respective opposite sides of the pressure channels 40 are made symmetric. Consequently, the equivalent step structure is provided at the bottoms of the ink channels arranged on the respective opposite sides of the pressure chamber. The present embodiment thus makes the ink channels symmetric with respect to the pressure chamber. As a result, the inclination of the ink ejection direction can be reduced, thus making improper printing conditions such as stripes and unevenness unnoticeable.

In the above-described embodiments, the height of the wiring layer is substantially equivalent to that of the step formed by the tight contact layer. However, the present invention is not limited to this aspect. That is, if the wiring layer and the tight contact layer have different film thicknesses and the corresponding films form different heights, the effects of the present invention can be exerted by utilizing the widths of the layers to make the flow resistance substantially symmetric. For example, if the height of the wire is smaller than the thickness of the tight contact layer, the effects of the present invention can be exerted by setting the width of the wire smaller than the arrangement width of the tight contact layer to ensure the symmetry of the flow resistance.

The embodiments have been individually described. However, any of the embodiments may be combined together. For example, a combination of the nozzle member and the tight contact layer enables substantially equal flow resistance to be adjustably set for the two channels.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-026168, filed Feb. 6, 2009, which is hereby incorporated by reference herein in its entirety.

What is claimed is:

1. An ink jet print head comprising:

a pressure chamber having an energy generation device that generates energy used to eject ink;

a first supply port provided on one side of the pressure chamber to supply ink to the energy generation device;

a second supply port provided on another side of the pressure chamber to supply the ink to the energy generation device; and a dummy wiring which does not contribute to energizing the energy generation device, and which is provided between the energy generation device and the first supply port or between the energy generation device and the second supply port and wherein a plurality of the first and second supply ports are arranged along an arrangement direction of plural energy generation devices, and a through-hole is formed between the first and second supply ports so as to connect to individual wiring.

2. The ink jet print head according to claim 1, wherein ink channels are formed opposite each other across the energy generation device.

3. The ink jet print head according to claim 1, further comprising:

a common wire connecting a power source and the energy generation device together; and an individual wire connecting the energy generation device and a driving circuit together.

4. The ink jet print head according to claim 2, wherein a common wire connecting a power source and the energy generation device together, an individual wire connecting the energy generation device and a driving circuit together, and the dummy wire not contributing to energization of the energy generation device are provided as wiring for the ink jet print head.

5. The ink jet print head according to claim 2, wherein the same flow resistance is set by applying a resin to the bottom portion of the ink channels.

6. The ink jet print head according to claim 5, wherein the applied resin is a polyetheramide-containing resin.

7. The ink jet print head according to claim 2, wherein the pressure chamber and the ink channels are provided on a board formed of stacked layers.

8. The ink jet print head according to claim 1, the dummy wiring extends in a direction which crosses a direction of supplying the ink to the energy generation device from the first supply port.

9. The ink jet print head according to claim 1, the dummy wiring and the energy generation device are not connected electrically.

* * * * *